United States Patent [19]

Crouch

[11] 3,981,399

[45] Sept. 21, 1976

[54] APPARATUS FOR HOLDING A PAINT BRUSH

[76] Inventor: William R. Crouch, R.R. 13, Box 468, Bloomington, Ind. 47401

[22] Filed: Sept. 22, 1975

[21] Appl. No.: 615,384

[52] U.S. Cl. ..... 206/15.2; 206/362.4; 211/65; 220/63 R; 248/110

[51] Int. Cl.[2] ..... B65D 51/26

[58] Field of Search ..... 211/65; 248/110, 111; 220/63, 4 E, 4 R; 206/209, 209.1, 361, 362.2, 362.3, 362.4, 15.2, 15.3

[56] References Cited

UNITED STATES PATENTS

| | | | |
|---|---|---|---|
| 1,869,753 | 8/1932 | Kamm | 206/361 |
| 1,931,293 | 10/1933 | Morck | 206/362.4 |
| 2,262,753 | 11/1941 | Brennan | 206/15.3 |
| 2,290,359 | 7/1942 | Ringler | 206/362.4 |
| 2,562,482 | 7/1951 | Weisser | 206/361 |
| 2,841,273 | 7/1958 | Scott | 206/362.4 |
| 2,947,412 | 8/1960 | Tupper | 206/362.3 |
| 3,026,998 | 3/1962 | Scully | 206/361 |
| 3,262,556 | 7/1966 | Morrison | 206/209.1 |
| 3,291,295 | 12/1966 | Caligiuri | 206/15.3 |
| 3,690,448 | 9/1972 | Switzer | 206/361 |

*Primary Examiner*—William Price
*Assistant Examiner*—Bruce H. Bernstein
*Attorney, Agent, or Firm*—Woodard, Weikart, Emhardt & Naughton

[57] ABSTRACT

An apparatus for holding and storing a paint brush. A variety of embodiments include a box assembly having a V-shaped interior wall to complementarily receive the bristled end of a paint brush. The box assembly includes an opening through which the handle of the paint brush projects. In one embodiment, the box assembly includes an inner box slidably mounted within an outer box. The V-shaped wall is an insert which is positionable within the inner box along with the paint brush. Slots in both boxes allow the paint brush handle to project externally of the assembly. Flanges on the insert limit relative movement of the paint brush and insert relative to the boxes. In another embodiment, the insert is centered in a V-shaped groove provided on a cap mountable to a box. In another embodiment, the insert is positionable within a box having the hinged lid with a V-shaped groove provided thereon to center the insert. In another embodiment, the V-shaped wall includes a pair of walls fixedly mounted respectively to an inner and outer box with the walls converging when the inner box is positioned within the outer box.

1 Claim, 7 Drawing Figures

APPARATUS FOR HOLDING A PAINT BRUSH

BACKGROUND OF THE INVENTION

1. Field of the Invention

This invention is in the field of devices for storing paint brushes.

2. Description of the Prior Art

Paint brushes are shipped by the manufacturer in either a lightweight cardboard covering or a small plastic wrapper. The cardboard covering or plastic wrapper is acceptable for storing the brush prior to the initial use of the brush; however, the cardboard covering and plastic wrapper both lack durability and deteriorate rapidly when exposed to the various solvents present on the paint brush. Eventually, the original cardboard covering or plastic wrapper is not acceptable for use and thus, the paint brush is stored in an unwrapped condition.

Professional painters use relatively expensive paint brushes which have a tapered bristled end to facilitate cutting. Cutting is a term used for describing painting of a wall up to a sharp line. For example, when painting a room, in many cases the wall will be painted a different color than the ceiling. Thus, the ceiling is first painted with the paint being cut off at the very top portion of the vertical wall. In order to obtain superior cutting, the paint brush must have a tapered bristled end. In the event that the bristles extend outwardly from the main body of the brush in various directions, a sharp line of paint will be impossible to obtain and the painting is therefore unsatisfactory. It is therefore desirable to store the paint brush in a tapered holder to prevent the bristles from extending outwardly from the main body of the brush.

SUMMARY OF THE INVENTION

One embodiment of the present invention is a paint brush keeper comprising a box assembly with a movable wall to allow insertion of a paint brush into the box assembly, the box assembly including a bottom and a top wall, the top wall having a hole through which the handle of the paint brush projects, the box assembly including a pair of diverging walls extending from the bottom to the top wall, the walls sized to receive and form the bristled end of a paint brush into a tapered configuration.

It is an object of the present invention to provide a paint brush keeper for storing the paint brush in a tapered and compact condition.

Another object of the present invention is to provide a new and improved paint brush holder.

Yet another object of the present invention is to provide a paint brush keeper which will not deteriorate when exposed to paint solvents.

Related objects and advantages of the present invention will be apparent from the following description.

DESCRIPTION OF THE PREFERRED EMBODIMENTS

Figure 1:
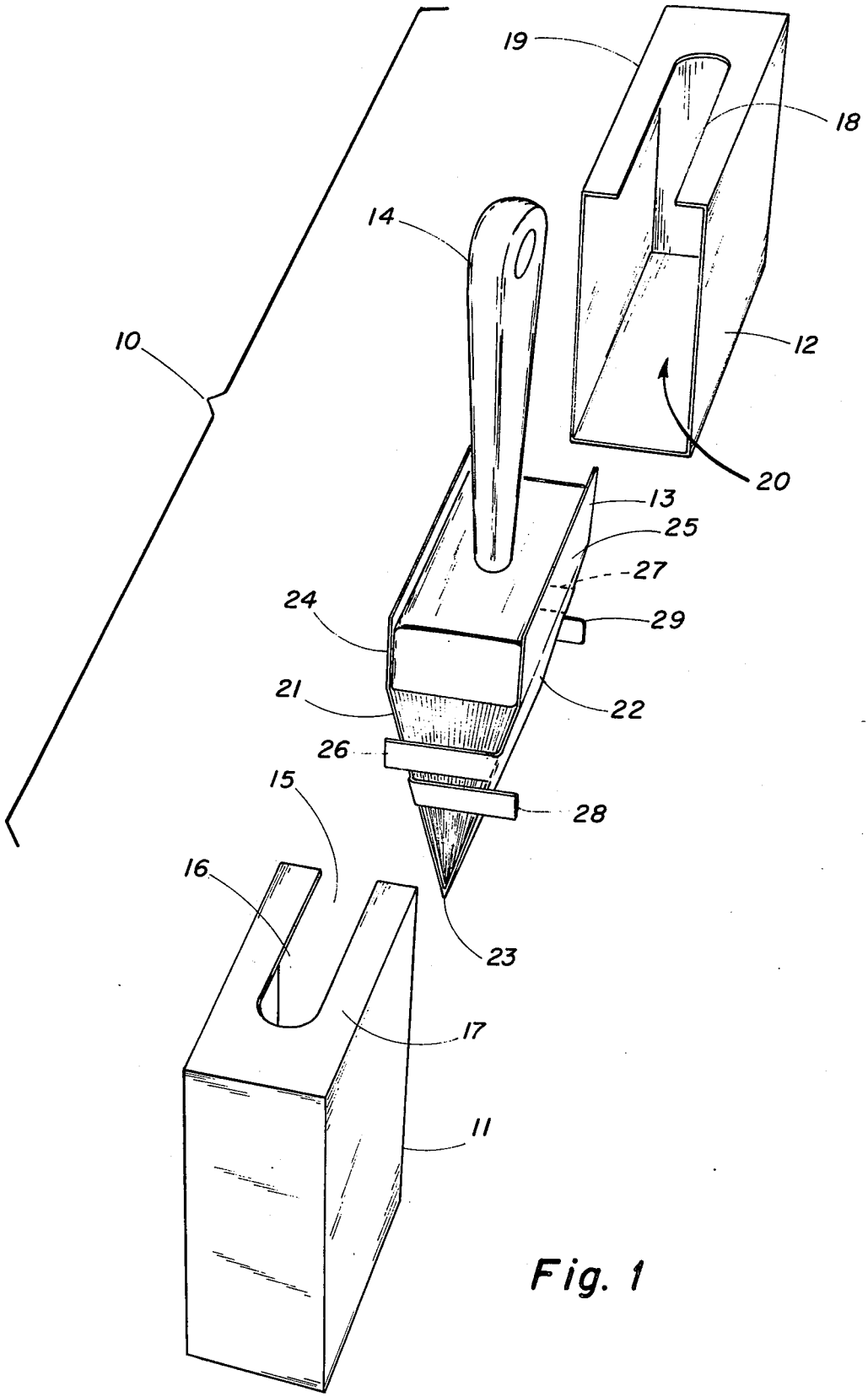
FIG. 1 is an exploded perspective view of the preferred embodiment of the paint brush keeper incorporating the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown the preferred embodiment of the paint brush keeper 10 incorporating the present invention. Keeper 10 includes a box assembly having an inner box 11 slidably mounted within an outer box 12. A V-shaped insert 13 receives the paint brush 14 with the insert and brush then being inserted into the inner box 11 which is then positioned within the outer box 12.

Box 11 includes five sides joined together with an open side 15 facing box 12. A slot 16 is provided in the top wall 17 of box 11. Likewise, box 12 is a five-sided box having a slot 18 provided in the top wall 19 of the box and with an open side 20 facing box 11.

Insert 13 includes a pair of diverging walls 21 and 22 joined together at the bottom 23 of the insert. Walls 21 and 22 diverge from bottom 23 up to locations 24 and 25 whereat the walls are then parallel up to the top of the insert.

A pair of flanges 26 and 27 are integrally connected to wall 22 and extend beyond wall 21 terminating immediately beneath the portion of wall 24 parallel with wall 25. Likewise, a second pair of flanges 28 and 29 are integrally connected to wall 21 and extend beyond wall 22 terminating at a position immediately beneath the portion of wall 25 parallel with wall 24. Flanges 26 through 29 abut against the interior surface of box 11 and thereby limit relative movement between the insert and box 11. Likewise, the flanges limit relative lateral motion between the paint brush and the insert.

Figure 2:
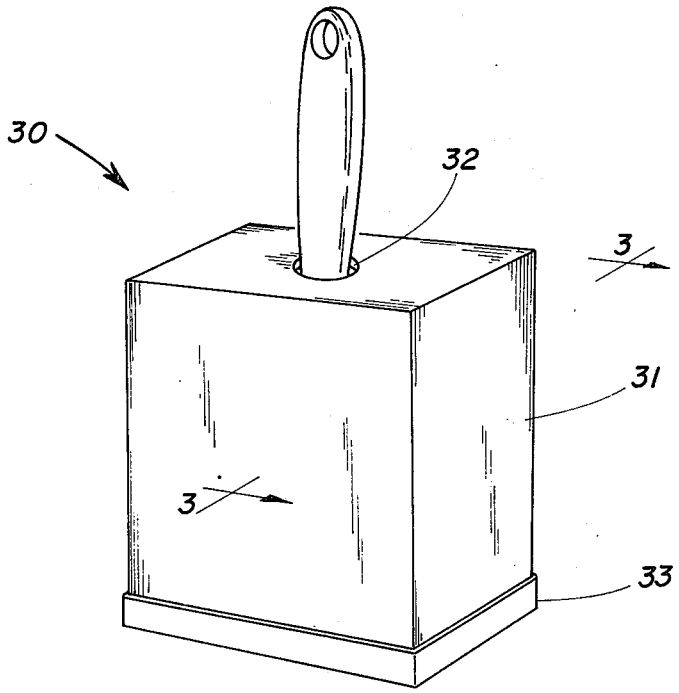
FIG. 2 is a perspective view of an alternate embodiment of the paint brush keeper.
Figure 3:
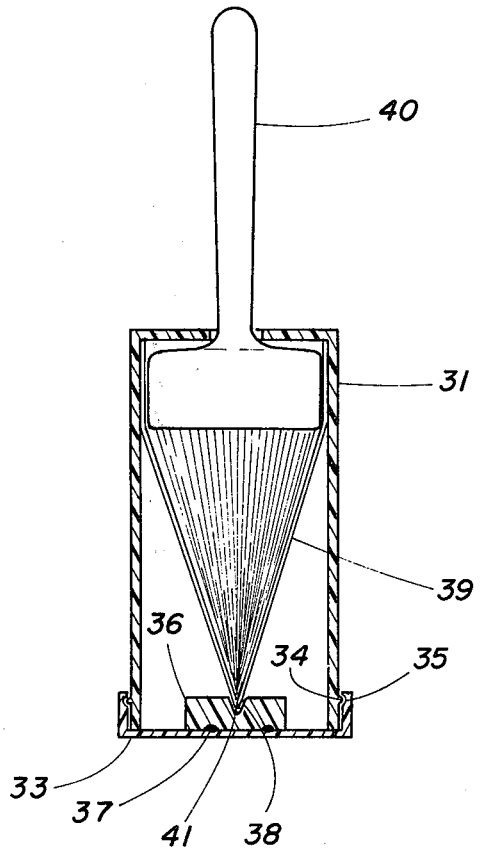
FIG. 3 is a cross-sectional view taken along the line 3—3 of FIG. 2 and viewed in the direction of the arrows.

An alternate embodiment of the paint brush keeper is shown in FIGS. 2 and 3. Keeper 30 includes a rectangular configured box 31 having a top wall with a hole 32 extending therethrough. The bottom of box 31 is closed by cap 33 which is removably mounted to the box and secured thereto by a force fit. Projections 34 are provided on the outer surface of box 31 and are received in grooves 35 provided on the upstanding walls of cap 33.

Block 36 is fastened by welds 37 and 38 to the inside surface of cap 33 with a groove 41 provided in the block to fittingly receive insert 39. Insert 39 is identical to insert 13 previously described. The paint brush 40 is first fitted into insert 39 with the insert and brush then positioned within the box allowing the handle of the paint brush to extend through hole 32. Cap 33 is then mounted to box 31 positioning projections 34 in grooves 35 and likewise positioning the bottom end of insert 39 within groove 41. Groove 41 therefore locates the insert within the box.

Figure 4:
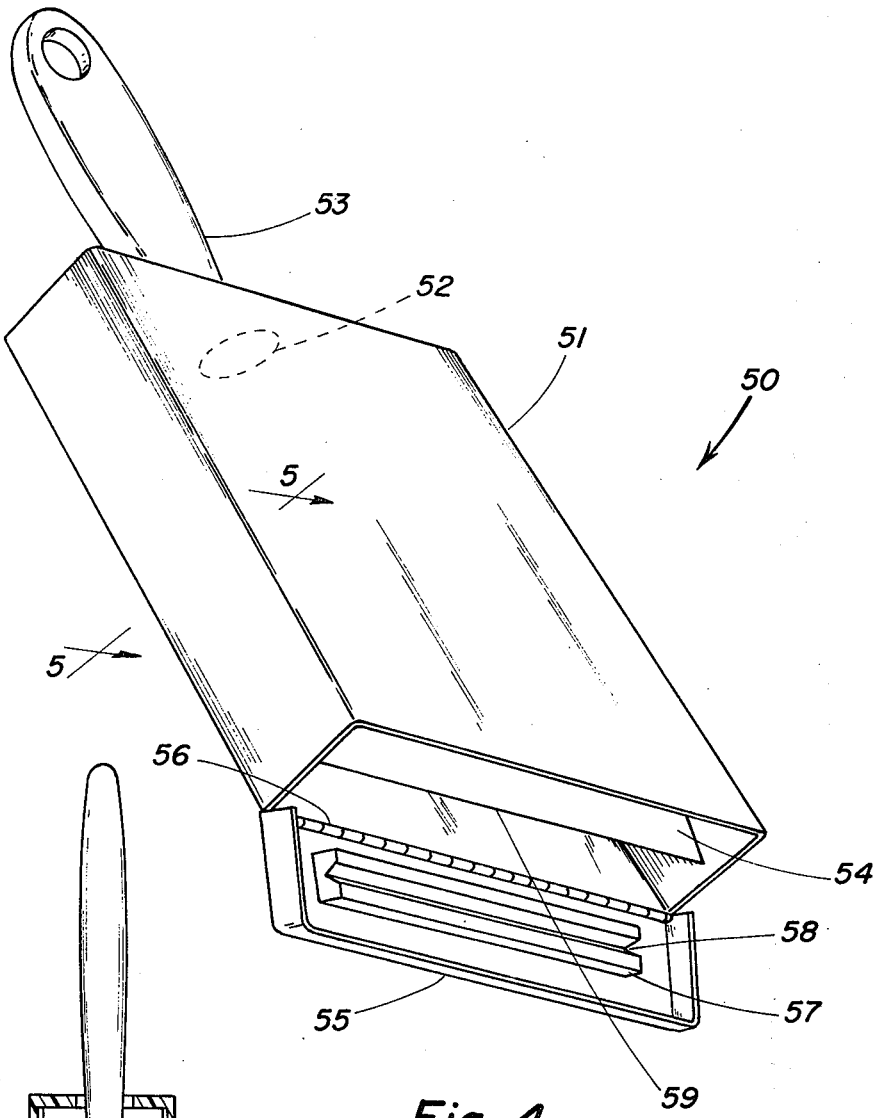
FIG. 4 is a perspective view of yet another embodiment of the paint brush keeper.
Figure 5:
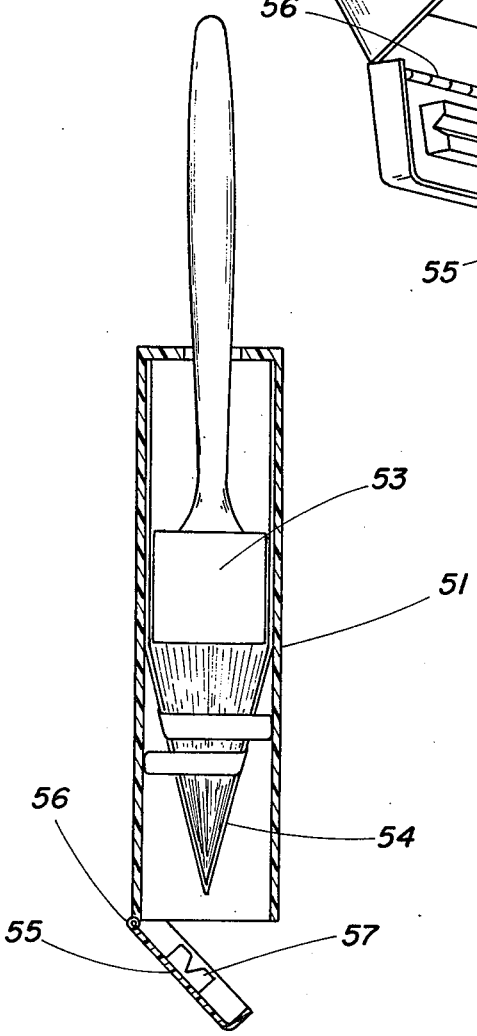
FIG. 5 is a cross-sectional view taken along the line 5—5 of FIG. 4 and viewed in the direction of the arrows.

Yet another embodiment of the paint brush keeper is shown in FIGS. 4 and 5. Keeper 50 includes a rectangular box 51 having an aperture 52 in the top wall of the box to receive the handle of paint brush 53. Likewise, an insert 54, identical to insert 13, is slidably positioned within the box in a manner identical to that described for keeper 30. A lid 55 is hingedly mounted by hinge 56 to box 51 and is provided with a block 57 mounted to the inside surface of the lid. Block 57 is provided with a V-shaped groove 58 to fittingly receive the bottom end 59 of insert 54. The paint brush is first positioned in insert 54 which is then inserted into the box. Lid 55 is then closed with the bottom end of the insert being received by groove 58.

Figure 6:
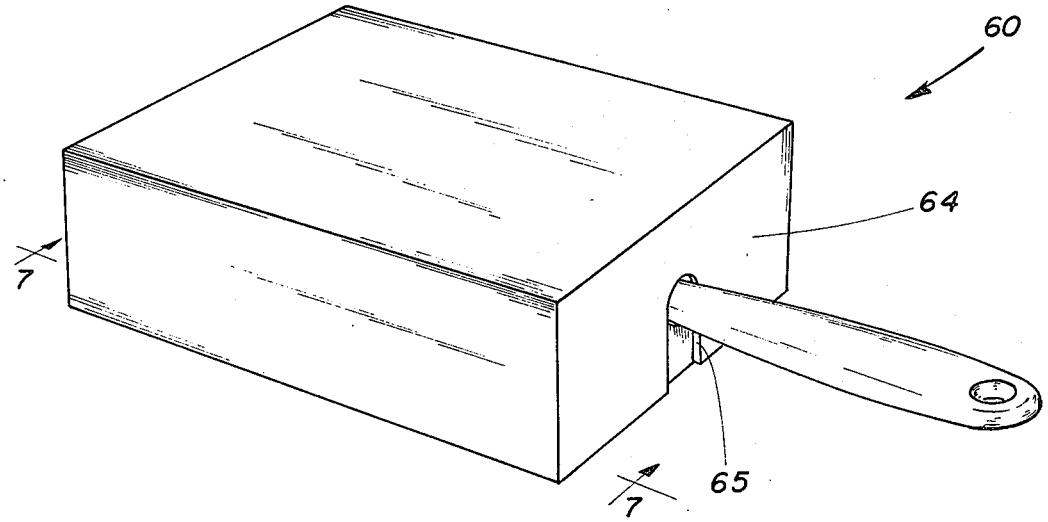
FIG. 6 is a perspective view of yet another embodiment of the paint brush keeper.
Figure 7:
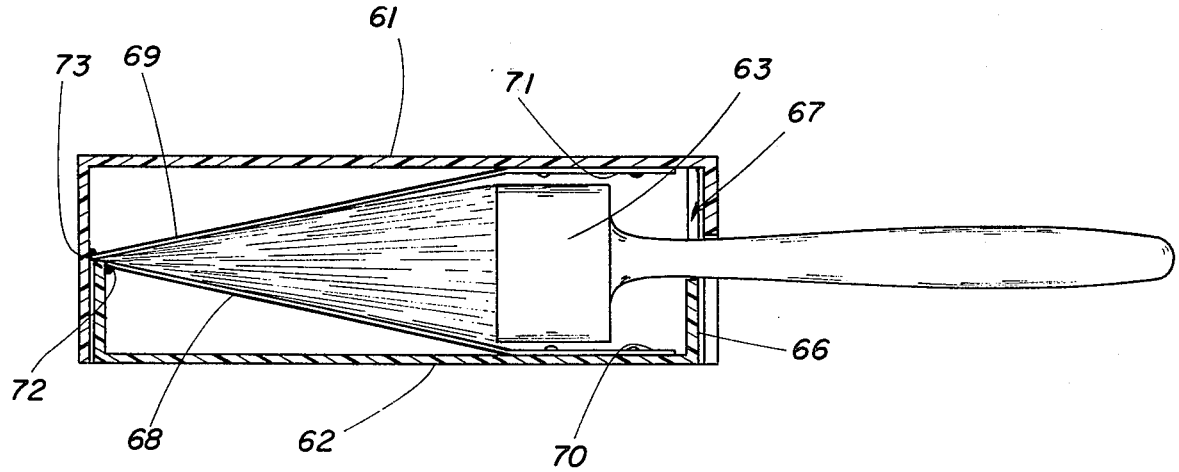
FIG. 7 is a cross-sectional view taken along the line 7—7 of FIG. 6 and viewed in the direction of the arrows.

Yet another embodiment of the paint brush keeper is shown in FIGS. 6 and 7. Keeper 60 includes a top outer box 61 into which a bottom inner box 62 fits with the paint brush 63 being held by box 62. Box 61 is a five-sided box having an open bottom whereas box 62 is a five-sided box having an open top. End wall 64 of box 61 is provided with a slot 65 whereas end wall 66 of box 62 is provided with slot 67. Slot 65 opens downwardly whereas slot 67 opens upwardly thereby allowing for the insertion of brush 63 into box 62 with the handle first projecting through slot 67 and then through slot 65 after the bottom box is inserted into the top box.

A pair of walls 68 and 69 configured as a V are respectively fixedly mounted to boxes 62 and 61. Wall 68 has a portion 70 parallel with a portion 71 of wall 69. Wall portions 70 and 71 are attached by welds respectively to the bottom wall of box 62 and the top wall of box 61. Walls 68 and 69 converge from portions 70 and 71 when the bottom box is positioned within the top box. The opposite end 72 of wall 68 is attached by welds to the upstanding end wall of box 62 whereas end 73 of wall 69 is attached by welds to the downwardly extending vertical end wall of box 61. Paint brush 63 is first inserted into box 62 with the bottom box then being positioned within the top box.

It will be obvious from the above description that the present invention provides a paint brush keeper having a box assembly with the box assembly including at least one box having a movable wall to allow insertion of a paint brush into the assembly. For example, in the embodiment shown in FIG. 1, the box assembly 10 includes a box 12 having a movable wall 19 relative to box 11 which allows the paint brush to be inserted into box assembly 10.

It will be further obvious from the above description that the paint brush keeper provides for the formation of the bristle end of the paint brush. The paint brush keeper may be produced form a variety of materials. For example, the boxes may be produced from metal coated with a solvent resistant material, such as polyethylene.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

The invention claimed is:

1. A paint brush keeper comprising:

a box assembly with a movable wall to allow insertion of a paint brush into the box assembly, said box assembly including a bottom and a top wall, said top wall having a hole through which the handle of the paint brush projects;

said box assembly including a pair of diverging walls extending from said bottom to said top wall, said walls sized to receive and form the bristled end of a paint brush into a tapered configuration; and wherein:

said pair of walls form an insert mounted within said box assembly;

said box assembly includes a box with an open bottom and box configured cap fittable on said open bottom closing said box assembly;

said cap includes an interior block with a V-shaped groove fittingly receiving and locating said insert.

* * * * *